United States Patent [19]

Towers

[11] 4,094,491

[45] June 13, 1978

[54] CORE FORM FOR LINING CONTAINERS

[75] Inventor: Jack E. Towers, Littleton, Colo.

[73] Assignee: Sandoz, Inc., E. Hanover, N.J.

[21] Appl. No.: 737,073

[22] Filed: Nov. 1, 1976

Related U.S. Application Data

[62] Division of Ser. No. 656,245, Feb. 9, 1976, abandoned, which is a division of Ser. No. 578,102, May 16, 1975, abandoned.

[51] Int. Cl.[2] ..... B29C 1/06

[52] U.S. Cl. ..... 249/83; 93/36.01; 249/185

[58] Field of Search ..... 249/83, 91, 93, 142, 249/172, 175, 187; 93/36.01; 264/46.6, 267, 268–269; 206/524

[56] References Cited

U.S. PATENT DOCUMENTS

| | | | |
|---|---|---|---|
| 887,814 | 5/1908 | Johnson | 249/172 |
| 3,680,825 | 8/1972 | Wachter | 249/33 |

*Primary Examiner*—Francis S. Husar
*Assistant Examiner*—John McQuade
*Attorney, Agent, or Firm*—Gerald D. Sharkin; Robert S. Honor; Walter F. Jewell

[57] ABSTRACT

The invention provides a mold for the molding of a resilient material to the insides of a container placed upon the mold.

1 Claim, 4 Drawing Figures

CORE FORM FOR LINING CONTAINERS

This is a division of application Ser. No. 656,245, filed Feb. 9, 1976, now abandoned, which in turn is a division of application Ser. No. 578,102, filed May 16, 1975, now abandoned.

This invention relates to molds for packaging material. More particularly, it relates to molds for resilient packaging material adhered to the interior surfaces of a container.

In the shipment of articles of commerce, it is often necessary and desirable to cushion the articles to insulate them from damage during shipment. This is especially necessary in the shipment of delicate instruments and scientific equipment. Heretofor, it would be the practice to use cushionable inserts, e.g., foam sections on the insides of the shipping container or to spray a foamable material on the insides of the container and then cap the lower and upper ends of the container with a cushionable or resilient insert. The use of inserts adds to the complexity of packaging goods, both in the necessity for using and storing the inserts; and in addition, require extra handling for packaging.

It is, therefore, an object of this invention to provide a shipping container, wherein a mold for preparing a resilient material is integrally bound to the insides of the container in one operation and which eliminates the need for packaging inserts.

These and other objects of the invention will be understood from the following detailed description and drawings; wherein FIG. 1 is a sectional view of a container of this invention;

Figure 1:
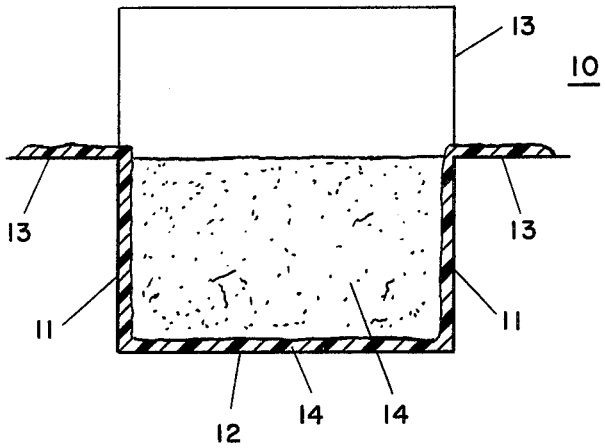

Broadly, this invention provides a mold for a container having in combination, a bottom, sides, and a hingedly attached lid, wherein a resilient material, e.g., polyurethane foam, is coextensively adhered to the interior surfaces of the bottom, sides, and lid of the container. This resilient material provides a cushionable surface for goods placed therein and protects them during shipment.

The resilient material may be any material that is capable of being foamed in place, such as polyurethane, and is capable of providing a cushionable surface for goods placed in the container.

The container may be any item of commerce used for the shipment of goods, such as a box-shaped container, and may be provided with a single-hingedly attached lid or the lid may comprise two or more hingedly attached lid flap-like portions, such as is found in the standard four-part lid commercial shipping container. When the container lid comprises four-lid portions, the resilient foamable material is coextensively attached not only to the bottom and interior sides of the container, but is coextensively attached to two of the opposing lid portions.

A plastic sheet of a self-lubricating plastic, e.g., polyethylene may be adhered to the exposed surface of the resilient cushionable material, which plastic sheet acts as a mold release agent.

The resilient material may be applied to the interior surface of a shipping container by placing the container over a mold with the bottom-side uppermost, wherein the mold substantially conforms to the interior dimensions of the container with the resilient material adhered thereto. At this point, the bottom of the container is open and a quantity of foamable, resilient material is applied to the interstices between the interior of the container and the mold. This is preferably done by applying the material from a dispensing gun as a foamable liquid, which liquid contains both the foamable material, e.g., polyurethane, and a catalyst. Upon exiting from the dispensing gun, the material immediately begins to foam and set. After waiting for a period of time for the foaming polyurethane material to substantially fill the interstices between the bottom, sides, and lid of the container and the mold and adhere to the interior surfaces of the container, the container is then released from the mold.

A suitable mold for applying the foamable resilient material to the interior surfaces of the container basically comprise in combination, a base having an inclined wedge-shaped end section and a center portion mounted centrally upon the base. The dimensions of the center portion conform substantially to the interior of the container that would be used with the resilient material coextensively adhered to the interior of the container. The center portion may also be constructed to form any desired shape upon the resilient material, e.g., conform the resilient material to the shape of the item to be placed in the container. The mold has at least two side walls fixedly mounted on the base and in spaced-apart relationship with the center portion for maintaining the container in alignment with the center portion. The mold is also provided with at least one end-flap hingedly affixed to the wedge-end of the end section and is pivitable on a hinge and removeably secured during foaming to the inclined portion of the wedge-section. The end section further has a recess between the sides thereof, wherein the flap portion holds the lid of the container over the recess so that the foam substantially fills the recess and adheres to the interior side of the lid.

Figure 2:
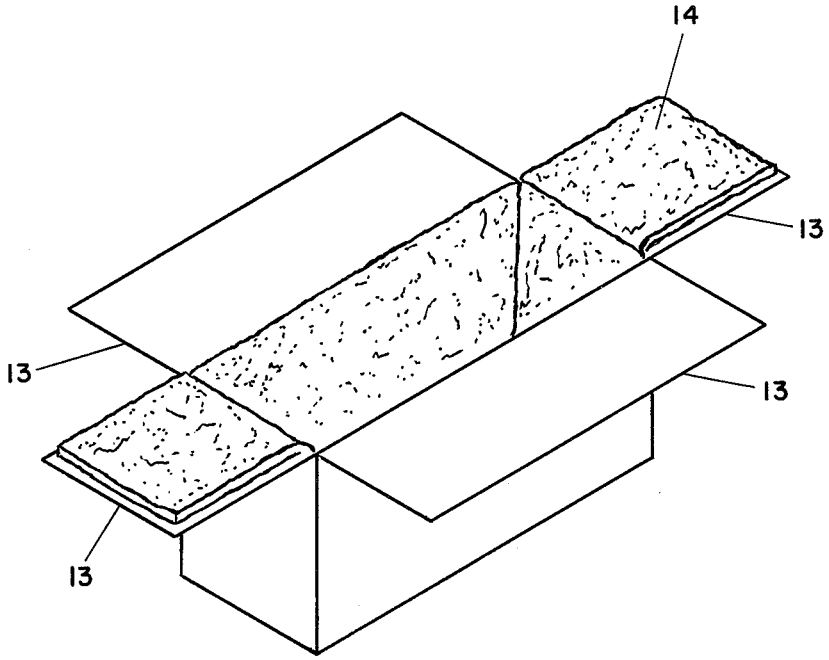
FIG. 2 is an isometric view of the container of FIG. 1.

This invention will best be understood by the following detailed description:

Referring now to FIG. 1, there is generally shown at 10, a container of this invention, having sides 11, a bottom 12, and top hinge portions 13. A foamable resilient material, e.g., polyurethane foam 14 is adhered to the interior surfaces of the container 10 and on two opposing lid portions 13 (see FIG. 2).

Figure 3:
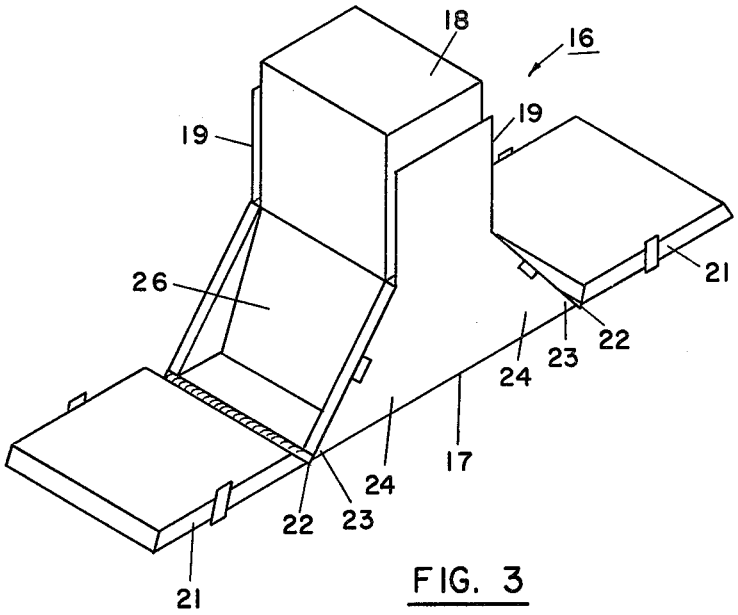
FIG. 3 is an isometric view of a mold of this invention.

The foam 14 is preferably adhered to the interior surfaces of container 10 by the use of a mold shown generally at 16 (see FIG. 3). The mold comprises a base 17; a center portion 18 mounted centrally upon the base 17; side walls 19; and flaps 21 attached by hinge means 22 to the wedge-end 23 of the end-section 24 of the base 17. The mold is further provided with a recess 26 in the end-section 24.

Figure 4:
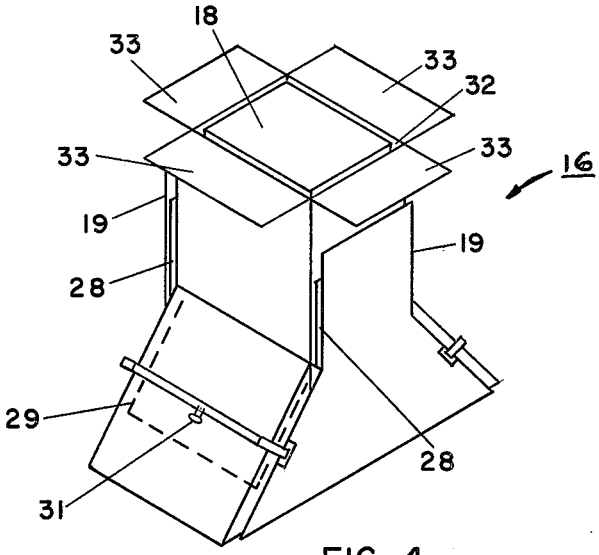
FIG. 4 is an isometric view of the mold of FIG. 3 with a container positioned upon it prior to the application of a resilient material.

In operation, a container without a cushionable interior (see FIG. 4) is placed over the center portion 18. Two opposing lid portions 28 are folded back upon the container and rest between the exterior side of the container and the side walls 19 of the mold 16. The other two opposing lid portions 29 one of which is shown in phanthom are placed over the recess 26 and the flaps 21 are then positioned over the lid portions 29 and secured to the end-section 24 by locking means 31, known in the art. A polyurethane foam is applied by means of a dispensing gun (not shown) to the interstices 32 between the center portion 18 and the container. A particularly advantageous dispensing gun is that manufactured by the Instapack Corp. of Danbury, Connecticut, wherein polyurethane is simultaneously mixed in a dispensing nossel with a catalyst, e.g., diphenyldiisocyanate and the mixture is extruded into the interstices 32. The polyurethane foams and sets within about 15 seconds, during which time, the bottom portions 33 forming the bottom of the container are closed and sealed. After the bottom is sealed, the flaps 21 are removed from the container lid-portions 29 and the container lifted from the mold.

While the above operation has been described in terms of a standard 200 # corrogated container, it is understood that the application is applicable to any shipping container, which is capable of having a resilient foam applied on the interior surfaces. For example, the bottom of the container could be solid, except for a small plug through which the urethane foam is applied. The lid of the container may be a single lid, or as described, a lid having four-flap portions on any other configuration providing only that the lid be hinged to the container.

In those operations, where it may not be possible or desirable to use a mold-release agent, a sheet of self-lubricating plastic, e.g., polyurethane, may be first placed over the center portion of the mold and the recess and then the container placed upon it so that the foamed material will be applied between the interior surface of the container and the plastic sheet. Upon completion of the foaming, the container with the plastic sheet adhered to the foam material, may be immediately lifted from the mold without any adhereance thereto.

This invention provides, as will be appreciated by those skilled in the art, a mold for adhering a resilient material to a shipping container, which is superior to that of the prior art.

What is claimed is:

1. A mold for applying a foamable resilient material to the interior surfaces of a container, comprising a base, a center portion centrally mounted on the base, the base having opposed wedge-shaped end sections, each end section defining an inclined portion which inclines from the center portion; two side walls fixedly mounted on the sides of the base and in spaced apart relationship with the center portion; an end flap hingedly affixed to each of the ends of the end sections, pivotable on a hinge and capable of being removably secured to the inclined portion of each of the end sections; each end section further having a recess between the sides thereof, wherein the end flap holds the lid of the container over the recess so that the foamable resilient material substantially fills the recess under the lid to adhere to the interior side of the container lid.

* * * * *